US005944316A

United States Patent [19]

Hernandez

[11] Patent Number: 5,944,316

[45] Date of Patent: Aug. 31, 1999

[54] 1-2-3 CARD GAME

[76] Inventor: Conrad B. Hernandez, 2655 W. Calle Tonala, Tucson, Ariz. 85745-2504

[21] Appl. No.: 09/100,585

[22] Filed: Jun. 19, 1998

Related U.S. Application Data

[60] Provisional application No. 60/050,185, Jun. 19, 1997.

[51] Int. Cl.[6] ..... A63F 1/00

[52] U.S. Cl. ..... 273/292

[58] Field of Search ..... 273/292, 274, 273/309, 303, 304, 305

[56] References Cited

U.S. PATENT DOCUMENTS

| | | | |
|---|---|---|---|
| 2,664,292 | 12/1953 | Lee . | |
| 4,362,303 | 12/1982 | Pell . | |
| 4,364,567 | 12/1982 | Goott . | |
| 4,492,378 | 1/1985 | Williams . | |
| 4,688,803 | 8/1987 | Ollington . | |
| 5,496,038 | 3/1996 | Kangsanaraks . | |
| 5,503,401 | 4/1996 | Nguyen . | |
| 5,529,309 | 6/1996 | Bartlett . | |
| 5,540,444 | 7/1996 | Nguyen . | |
| 5,676,375 | 10/1997 | Pirougkhah | 273/292 X |
| 5,746,432 | 5/1998 | Feola | 273/292 X |
| 5,772,211 | 6/1998 | Nazaryan et al. | 273/292 |
| 5,857,676 | 1/1999 | Whitson | 273/292 |
| 5,868,391 | 2/1999 | Abood | 273/292 |

FOREIGN PATENT DOCUMENTS

| | | |
|---|---|---|
| 2066086 | 7/1981 | United Kingdom . |

*Primary Examiner*—William E. Stoll

*Attorney, Agent, or Firm*—Kenehan, Lambertsen & Stein; John C. Lambertsen

[57] ABSTRACT

A method for playing a card game having wagering opportunities. Wagering selections are made from among a group of possible playing card outcomes, with the winning outcome selected using a specialized die. After all bets have been placed, a single playing card is dealt face down at each of certain pre-identified locations. Indicia on each of the faces of the die collectively correspond to each of the pre-identified locations. The indicia observed on the up-turned face of the die after its throwing or tumbling determines the location at which the playing card is turned over. The turned-over card is considered to be the "winning" playing card, and its value is used to settle all bets prior to initiation of a new game.

10 Claims, 3 Drawing Sheets

| | | | 0 | A | A | A | A | 2 | 2 | 2 | 2 | 3 | 3 | 3 | 3 | 4 |
|---|---|---|---|---|---|---|---|---|---|---|---|---|---|---|---|---|
| | | | | CLUB | SPADE | HEART | DIAMOND | CLUB | SPADE | HEART | DIAMOND | CLUB | SPADE | HEART | DIAMOND | |
| TOP WAGERING | 72 | ZERO | X | | | | | | | | | | | | | |
| TOP WAGERING | 74 | FOUR | | | | | | | | | | | | | | X |
| TOP WAGERING | 70 | ZERO/FOUR | X | | | | | | | | | | | | | X |
| TOP WAGERING | 66 | BLACK | | X | X | | | X | X | | | X | X | | | |
| TOP WAGERING | 68 | RED | | | | X | X | | | X | X | | | X | X | |
| BOTTOM WAGERING | 76 | ACE | | X | X | X | X | | | | | | | | | |
| BOTTOM WAGERING | 78 | TWO | | | | | | X | X | X | X | | | | | |
| BOTTOM WAGERING | 82 | THREE | | | | | | | | | | X | X | X | X | |
| BOTTOM WAGERING | 84 | BLACK | | X | X | | | X | X | | | X | X | | | |
| BOTTOM WAGERING | 86 | RED | | | | X | X | | | X | X | | | X | X | |
| BOTTOM WAGERING | 88 | CLUB | | X | | | | X | | | | X | | | | |
| BOTTOM WAGERING | 94 | SPADE | | | X | | | | X | | | | X | | | |
| BOTTOM WAGERING | 92 | HEART | | | | X | | | | X | | | | X | | |
| BOTTOM WAGERING | 96 | DIAMOND | | | | | X | | | | X | | | | X | |

Fig. 4

1-2-3 CARD GAME

CROSS-REFERENCE TO RELATED APPLICATION

This application claims the benefit of U.S. Provisional Application No. 60/050,185, filed Jun. 19, 1997.

BACKGROUND OF THE INVENTION

1. Field of the Invention

The present invention relates to card games of skill and chance and, more particularly, to such playing card games as are suitable for use in casinos. More specifically, this invention relates to such card games as combine a customized decks of playing cards with a separate random event generator, such as one or more dice, that interact with one another to determine a winning event.

2. Description of the Prior Art

Card games are considered by many to be educational, stimulating, and exciting social activities. Many of the more popular card games are designed to mentally involve as well as test the strategic abilities of each individual player. These same characteristics are often further enhanced when the card game is combined with an opportunity for placing wagers.

A successful casino card game must hold the interest of the players in both a monetary and non-monetary manner. In addition to enjoying the play of the game, the players must also entertain the perception that each of them has a possibility of winning the wager. There must be something inherent in the game or its manner of play that involves a player, without regard to financial gain and/or despite the occurrence of wagers lost.

For some games or players, this inherent characteristic might be the thrill generated by the chance that "luck" will visit the player. For other games, the skill level of the player is perceived to significantly effect the outcome of game play. For some of the more popular games, the needs of both types of players are met—those having no interest of finer details of play, as well as persons desiring to maximize their ability to control play of the game through mastery of playing skills and strategy.

There are two general types of wagering playing card games, the "poker" type and the "banking" type. In poker wagering games, two or more players compete against one another. Poker-type playing card games tend to emphasize a competitive aspect that appeals to card players that are more confident of their skill level and less reliant on "luck." Also, during poker-style games the manner of wagering results of the transfer of monies among the players within that playing group. Many potential players are not comfortable with such inter-player money wager transfers. In such poker-type games it is readily apparent that a winner's gain is at the immediate expense of another player's loss.

In contrast, banking-type wagering games permit the players to essentially compete against the "house" or casino, whether present in the form of a dealer or generically as a "bank" that does not specifically participate in the particular game. By playing against an impersonal "house," any losses are paid out of the "corporate" or common fund, and not the result of a fellow player's loss. In addition, most players are aware that the house "shapes" the winning odds to assure a statistical advantage.

"Banking"-type wagering games are typically played against a dealer or a "bank" player, although a few such games provide no "dealer hand" to play against, with the object being to reach a certain winning combination. Otherwise, the goal for most "banking" wagering games is to beat the dealer's or "bank" player's hand. For example, in blackjack each playing card is assigned a predetermined point value and the object for each player is to be closer to 21 points (but not to exceed that value) than is the dealer's hand.

"Banking"-type wagering games have generally made use of a wider variety of game strategy than have the field of "poker"-type wagering games. Once again, using the game of blackjack as an example, as a "banking"-type wagering game, it generally requires very little skill on the part of the player. For the most part, wagering results are determined by the luck of the draw and not by a player's skill. In contrast, poker requires considerable card skill in order to obtain better wagering results.

Additionally, in the types of wagering games in which a player attempts to most closely approach a predetermined value or card count with his or her cards, the manner of play in casinos has frequently discouraged beginning players or those having little casino gaming experience. While the game rules are typically relatively simple, at the casino level they are played at an extremely fast pace, to increase their income value to the casino. It thus can be difficult for a novice player to keep up with the pace of the game and calculate the numerical differences and totals required in order to understand the play of the game.

In addition, many of these games wherein the object is to reach a given maximum count provide that exceeding such maximum allowable count results in a "bust," automatically eliminating that player from further play in that hand. Players can be discouraged by such occurrences. Games in which players cannot "bust" permit the players to continue play of the hand, thereby providing greater enjoyment for all of the players.

Accordingly, it is important that there be aspects of a banking-type game that include the step of placing wagers or bets on the point count or value of cards dealt by a dealer. Such a playing card game, while including possible bets for players that permit winning wagers based upon the occurrence of a specific playing card value rather than based only upon the relative numerical values of the card hands, should not include rules in which the players "bust" by exceeding a predetermined point total. The game should also permit a novice player to easily determine whether a winning wager has been placed, and not require complex mathematical computations to calculate playing card point values.

SUMMARY OF THE INVENTION

It is an object of the present invention to provide a casino playing card game of relative simplicity, requiring players to make their wagering selections from a limited group of possible playing card outcomes. It is a further object of the present invention to simplify the mechanics of selecting such outcomes by utilizing a separate random selector, such as one or more dice, to determine the winning outcome from among multiple possible, pre-dealt playing card results.

It is a still further object of the present invention to involve both the dealer and each player in different aspects of the play of the game. Each player may select from a field of possible wagering outcomes, with the dealer determining the winning outcome at the conclusion of a two-step selection process following the close of further wagering. In addition, by providing separate, random selectors, the opportunities are reduced for either a player or dealer to cause or predict a specific outcome.

It is a still further object of the present invention to increase the number and pace of betting opportunities by providing a simplified procedure for determining winning playing card outcomes, with the value of each such outcome able to be readily determined by both the dealer and the individual players.

Some further objects and advantages of the present invention shall become apparent from the ensuing description and as illustrated in the accompanying drawings.

BRIEF DESCRIPTION OF THE DRAWINGS

FIG. 4 is a schematic diagram depicting the relationship between the activated indicator lights, the selected playing card, and the wagering areas, in accordance with the present invention.

DETAILED DESCRIPTION OF THE EMBODIMENTS

As used in this specification, the term "casino card game" refers to a card game in which the casino or "house" acts as the banker, collecting all losing wagers and paying all winning wagers. The casino is the "dealer" of the game, and individual players play against the casino and not against one another. Additionally, although the play of the game will be illustrated by making reference to a specific game layout, it should be understood and appreciated that the playing card casino game system of the present invention can be played with a different layout, or without the use of a layout, and still be within the scope of the present invention.

Figure 1:
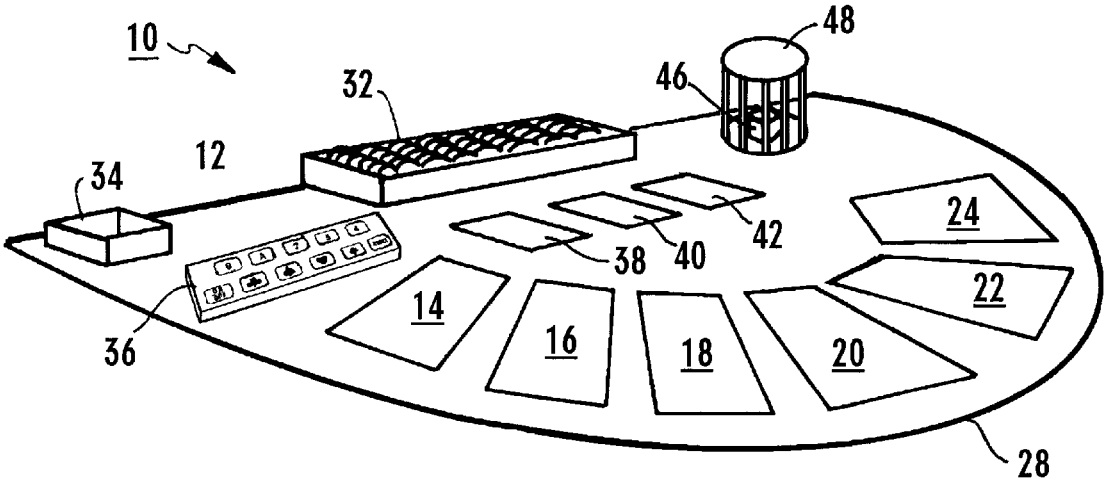
FIG. 1 is a perspective view showing a playing surface arranged in accordance with the principles of the present invention.

Reference is now made to the drawings wherein like numerals refer to like parts throughout. In FIG. 1 there is shown a gaming table layout arranged in accordance with the principle of the present invention, and designated generally by reference numeral 10. In a preferred embodiment, the gaming table layout 10 is generally semicircular in shape, and is preferably sized to have approximately the same dimensions as a conventional casino gaming table layout of the type normally used to play blackjack.

A dealer position 12 is centrally located along a linear, rear edge of the gaming table layout 10. A plurality of wagering areas 14, 16, 18, 20, 22, 24 are evenly spaced apart along a semicircular, curved player periphery 28. As so located, the plurality of wagering areas 14–24 are arranged opposite the dealer position 12, permitting the dealer to face each of the players of the game, and for each of the players in turn to face the dealer.

An area is provided immediately adjacent the dealer position 12 for placement of a chip tray 32. Casino games are typically played using chips rather than actual currency, and the chip tray 32 is available for use by a dealer as the "bank," storing the playing chips used to pay winning wagers and as a receptacle for playing chips obtained by the dealer from losing bets.

Each of the wagering areas 14–24 defines an area for placement of wagers by each player of the playing card game in accordance with the present invention. In addition, the wagering areas 14–24 enumerate the payoff odds for each specific winning wager, as well as defining the additional opportunistic wagers available under the rules of the playing card game defined by the present invention. Corresponding to this schedule of regular wagers and opportunistic prediction spaces is the dealer's console 36 that is located adjacent the dealer position 12, and preferably between the chip tray 32 and a playing card discard holder 34. The dealer's console 36 significantly assists the dealer by identifying winning wagers during play of the game, as is more fully discussed below.

A plurality of individually-defined playing card layout areas 38, 40, 42 are arranged in the central portion of the gaming table layout 10. The plurality of playing card layout areas 38–42 correspond in number to playing cards dealt by the dealer during play of the game. In a preferred embodiment, three playing cards will be dealt, and thus the gaming table layout 10 will provide three playing card layout areas 38, 40, 42, as is shown in FIG. 1.

It is presently preferred that each of the individual playing card layout areas be provided with identifying indicia distinguishing each of the individual playing card layout areas. Thus, the three playing card layout areas 38, 40, 42 preferably are identified as "card one," "card two," and "card three," respectively. As will be discussed in greater detail hereinafter, after the players have made their initial wagers, play of the game begins by the dealer placing a playing card in each of the individual playing card layout areas 38, 40, 42, and then placing the remaining playing cards in the playing card discard holder 34.

In accordance with the preferred rules of the game, selection of the playing card is in part dependent upon use of a single die 46 having indicia on its sides that correspond to the indicia associated with each of the playing card layout areas 38–42. The single die 46 is preferably located within a brass cage 48 or a dice cup (not shown) to facilitate the use of the die in a manner that minimizes the opportunity for manipulation to effect a nonrandom outcome. Once selection of the playing card has been accomplished, the play of the hand continues to completion.

In accordance with the rules for the preferred playing card game of the present invention, a special deck of playing cards is required. A single 38-card deck of playing cards is preferably used, and consists only of aces, two's, three's, a "zero" card, and a "four" card. Alternatively, a presently preferred variation eliminates the "four" card and replaces the "zero" card with the more conventional, "joker" card, resulting in a 37-card deck. In either case, there are twelve aces, three of each suit, spades, clubs, hearts, and diamonds, twelve two's, again, three from each suit, twelve three's, three from each suit, and the previously mentioned "joker" or the "zero" card and the "four" card.

In a preferred embodiment, the gaming table layout 10 is formed of a felt or like material, and the various defined areas are placed on the playing surface by a silk screen process. Additionally, while the gaming table layout 10 shown in FIG. 1 depicts a layout for six players, an additional wagering area for a seventh player can be placed therein, depending upon the dimensions of the player's layout, as well as upon the "comfort zone" area for each player that is desired.

Figure 2:
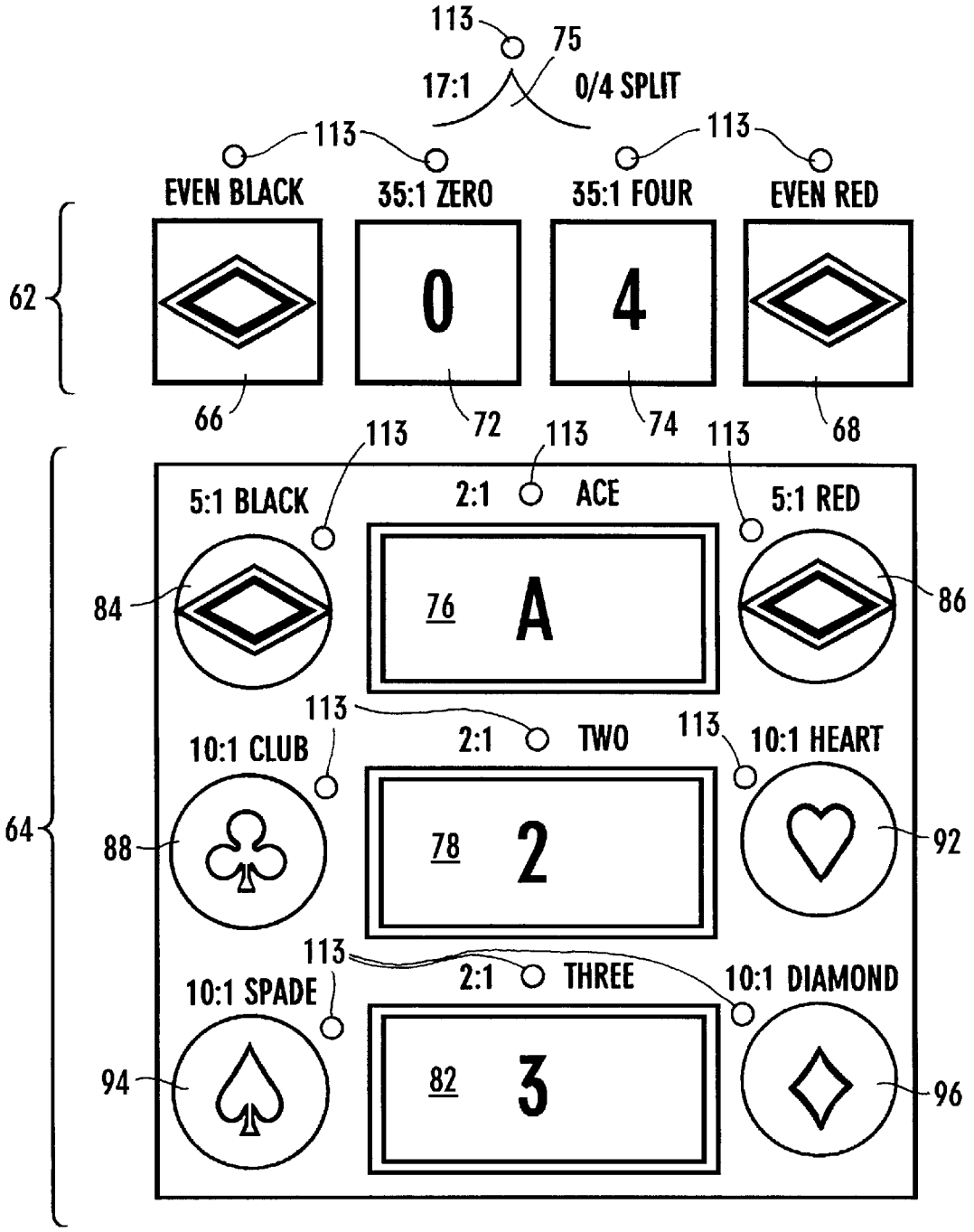
FIG. 2 is a diagrammatic plan view of a typical playing area layout for the card game system described by the present invention.

FIG. 2 provides some additional details regarding the wagering areas. Each of the plurality of wagering areas 14–24 are substantially identical to that depicted in FIG. 2 and consist of an independent betting field 62 and a dependent betting field 64. A plurality of individual betting spaces within each of the betting fields define specific wagers. The independent betting field 62 is shown in FIG. 2 as including four individual betting spaces, each of which bear indicia providing the payoff odds associated with that space should a wager placed thereon be successful. Included within the independent betting field 62 are a black betting space 66 and a red betting space 68. Winning wagers placed on either of such betting spaces receive even odds, and a winning event is defined by the color of the selected playing card, "red" or "black."

The independent betting field 62 also includes two specialized betting areas, a "zero" betting space 72 and a "four" betting space 74. Both of these specialized betting areas are associated with the "zero" and the "four" playing card of the modified playing card deck utilized in the present invention. The payoff line for both the zero betting space 72 and the four betting space 74 are 35:1. As noted previously, a presently-preferred, simplified game replaces the "zero" option with a "joker", and eliminates the "four" betting space. This alternative is not depicted in FIG. 2.

When the "zero" and the "four" betting spaces 72, 74 are included as betting options, it is further contemplated by the rules of the present invention that the independent betting field 62 also permit a player to "split" his or her bet with regard to both the "zero" and the "four" playing cards, with a split betting area 75 provided. In such an instance, should either the "zero" card or the "four" card be selected, the payoff for a "split" wager is 17:1.

The dependent betting field 64 likewise includes a plurality of individual betting spaces relating to different wagers. A group of betting spaces within the dependent betting field 64 are dominant in the sense that the wagering outcome of wagers placed on other betting spaces within the dependent betting field 64 are dependent upon the results of the wagers placed in the dominant betting spaces, namely an "ace" betting space 76, a "two" betting space 78, and a "three" betting space 82. The payoff for wagers placed on either of these three betting spaces is 2:1, and by so placing a bet, the player is wagering that the playing card in play will be an "ace," "two," and/or "three," respectively.

As will be more fully explained hereinafter, the remaining betting spaces within the dependent betting field 64 will pay only if the wager placed on the "ace" betting space 76, the "two" betting space 78, and/or the "three" betting space 82 are successful. These "subservient" betting areas include a dependent "black" betting space 84, a dependent "red" betting space 86, a dependent "club" betting space 88, a dependent "heart" betting space 92, a dependent "spade" betting space 94, and a dependent "diamond" betting space 96. The payoff for the "black" and "red" betting spaces 84, 86 is 5:1, and for the "club," "heart," "spade," and "diamond" betting spaces 88, 92, 94, 96, is 10:1.

To describe the operation of the invention, set forth in the following are the rules of play:

At commencement, the playing cards are shuffled, and presented to a randomly-selected player who cuts the deck. Unlike blackjack, the players are not playing against the dealer, they are simply attempting to predict the identity of a playing card by placing wagers on one or more of the available betting spaces within each player's wagering area.

After all of the players have placed their wagers, the dealer preferably "burns" the first card and then proceeds to deal three cards, face down, one placed inside each of the playing card layout areas 38, 40, 42. The remaining cards are placed in the discard tray 34.

The dealer then rotates the brass cage 48, causing a tumbling of the single die 46 within the brass cage 48, and then turns over the playing card within the playing card layout area that bears the indicia shown on the single die 46 in the brass cage 48—or that is revealed upon removal of the pai gow dice cup (not shown). That playing card is turned over, revealing the playing card value to all of the players. This card defines the "winning" playing card value, i.e., based upon this value, both the "winning" and "losing" wagers are defined. Upon turning over the playing card, the dealer proceeds to collect the losing wagers and to pay the winning wagers at the payoff odds associated with each of the betting spaces. The playing cards are then reshuffled, and the playing process is repeated for each subsequent round of wagers.

As previously mentioned, the gaming table layout 10 depicted in FIG. 1 is designed to accommodate six players comfortably. However, depending upon the overall dimensions of the players layout, as well as upon the individual player comfort zone area desired, seven player areas could be accommodated using a table having the same dimensions as that required for FIG. 1. By placement of their chips on the various betting spaces, the players are thereby indicating their respective beliefs regarding the results to be obtained by the succeeding, upturned playing card. Should that playing card be turned over by the dealer, those players encountering success on their previous wagers are paid based upon the number of chips wagered and the odds quoted with respect to each winning betting space.

As an example, if a player were to place a wager upon the "two" betting space 78, as well as on the dependent "black" betting space 84 and on the dependent "spade" betting space 94, and the subsequent upturned card is revealed to be the "two of spades," that player will receive two (2) chips from the dealer for every chip the player has placed on the "two" betting space 78. If that player had originally placed one chip on that betting space, after the successful outcome of the "two of spades," that player would then possess three chips, two chips received from the dealer for winning, plus that player's original chip. Additionally, for each chip placed on the dependent "black" betting space 84, the player would receive from the dealer an additional five chips for every chip bet. Thus, if that player had originally placed one chip on that space, the player would be given five chips from the dealer as well as being able to keep the original chip, for a total of six chips.

This successful player would also receive ten chips for every chip that player had previously placed on the dependent "spade" space 94. If that player had placed one chip in the dependent "spade" betting space 94, the successful result would provide the player with eleven chips, the ten received from the dealer plus the original chip. However, had the upturned card been an "ace" or a "three," the player would have lost all of the chips to the dealer. In addition, should the dealer turn up either the "zero" or the "four" card (or the "joker" in that game variation), all of the players who have not bet on such an occurrence would lose all of their bets.

In a presently-preferred variation, a wagering limit is placed upon the dependent bets, based upon the amount of the wager placed upon the independent wagering options. Under such circumstances, the amount of the wager placed upon the dependent propositions must not be in excess of twice the amount of the wager placed upon the primary, independent wagering options. For example, if the player places a $5 wager upon the "two" betting space 78, any wager placed upon the dependent, "spade" betting space 94 must not exceed $10.

The present invention is further demonstrated by the following examples of play:

EXAMPLE 1

Each of the following outcomes will be based upon the player making the following bets: (1) two monetary units on the black betting space 66; (2) a single betting unit on the "zero" betting space 72; and (3) three betting units on the "zero/four" split betting area 75. If the upturned playing card is a "zero," the dealer then proceeds to collect the bets from all players who have selected betting spaces other than the following: (1) the "zero" betting space 72; and (2) the "zero/four" split betting area 75. The units bet on the "black" betting space 66 are lost; however, the player wagered, a single unit on the "zero" betting space 72, and consequently would receive thirty-five betting units plus that player's original betting unit, for a total of thirty-six betting units. For that player's three betting unit wager on the "zero/four" split betting area 75, the player would receive fifty-one betting units as a result of the win, plus the original three, for a total of fifty-four betting units from the "zero/four" split wager.

With the same bets, this time the upturned playing card is the "three of spades." In this case, the winning bet spaces include only the following: (1) the "black" betting space 66, (2) the dependent "black" betting space 84, (3) the "three" betting space 82, and (4) the dependent "spade" betting space 94. Since this player had wagered two betting units on the black betting space 66 that player would receive even odds, resulting in a win of two betting units (two multiplied by one), plus the original bet, for a total of four betting units.

Upon placement of the same wagers, however, in this case, the upturned playing card is the "three of hearts." The only winning betting spaces are the following: (1) the "red" betting space 68, (2) the dependent "red" betting space 86, (3) the "three" betting space 82, and (4) the dependent "heart" betting space 92. Since wagers have been placed in none of these winning betting spaces, all of the placed bets would have been lost.

EXAMPLE 2

The next sequence of playing card results will be based upon the following wagers: (1) two betting units placed on the "ace" betting space 76; (2) a single betting unit placed on the dependent "club" betting space 88; and (3) three betting units placed on the dependent "red" betting space 86.

In the first instance, the upturned playing card is the "ace of clubs." The only winning betting spaces are the following: the "black" betting space 66, the dependent "black" betting space 84, the "ace" betting space 76, and the dependent "club" betting space 88. Since two betting units had been placed on the "ace" betting space 76, four betting units would be received from the dealer (two times two betting units), which, when combined with the initial two betting units, yields a total of six betting units. For the single betting unit wager placed on the dependent "club" betting space 88, the dealer would pay the player ten betting units in accordance with the playoff odds, which combined with the initial betting unit yields a total of eleven betting units. The three betting units placed on the dependent "red" betting space 86 would be lost.

In the next instance, the upturned playing card is the "two of diamonds." The following betting spaces are the only winning spaces: the "red" betting space 68, the dependent "red" betting space 86, the "two" betting space 78, and the dependent "diamond" betting space 96. The two betting units placed on the "ace" betting space 76 would be lost. The single betting unit placed on the dependent "club" betting space 88 would also be lost. Finally, since the "dependent" betting spaces are linked to the primary or dominant betting space, in this case the "ace" betting space 76, the loss of that space, since the "two of diamonds" was turned over, results in a loss of the three units placed on the dependent "red" betting space 86, even though the upturned playing card was "red."

In the next instance, the upturned playing card is the "ace of hearts." The following betting spaces are the only winning betting spaces: the "red" betting space 68, the dependent "red" betting space 86, the "ace" betting space 76, and the dependent "heart" betting space 92. Since two betting units were successfully placed on the "ace" betting space 76, the dealer will pay four betting units (two times two units), which, when combined with the original wager, yields a total of six betting units. For the three betting unit wager on the dependent "red" betting space 86, the dealer will provide fifteen betting units (five times three units), which, when combined with the original three betting unit wager, yields a total of eighteen betting units. The single betting unit wager on the dependent "club" betting space 88 would be lost.

The preceding examples make apparent the difference between wagers placed in the independent betting field 62 and those placed within the dependent betting field 64. Wagers placed on the "black" betting space 66 or the "red" betting space 68 within the independent betting field 62 are not tied to the result of the numerical value of the winning or "action card." Wagers placed on the "zero" betting space 72 or the "four" betting space 74 or the "zero/four" split combination within the independent betting field 62 are also in the form of a specialized bet and are not tied to any bet placed upon the "black" or "red" betting spaces 66, 68. In contrast, wagers placed on the dependent betting spaces within the dependent betting field 64 are successful only if a winning wager is placed within the dominant wagering areas, namely, the "ace" betting space 76, the "two" betting space 78, and the "three" betting space 82.

As can readily be appreciated, with each player having a multitude of possible wagering opportunities, and with single action card results yielding multiple different winning wagers, the dealer is likely to be faced with a multitude of different winning and losing wagers. In a preferred embodiment of the present invention, the dealer is provided with the dealers console 36 to assist the dealer in readily recognizing the winning and losing wagers.

Figure 3:
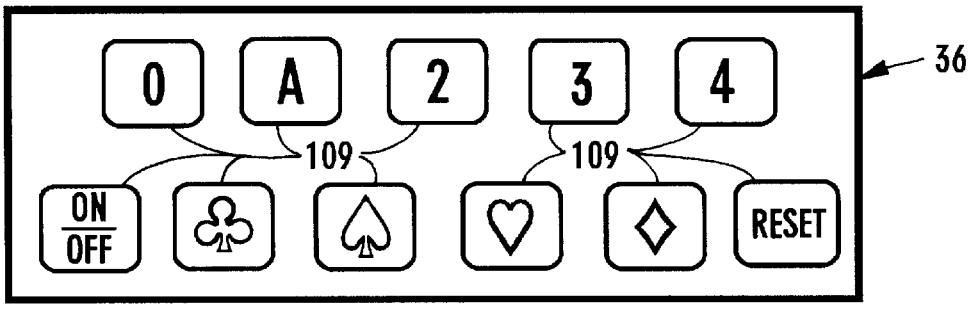
FIG. 3 is a diagrammatic plan view of a dealer's console showing one embodiment of the card game system described by the present invention.

Turning now to FIG. 3, the dealer's console 36 consists of a plurality of activation buttons 109 that are connected through known mechanisms to a plurality of indicator lights 113 located on each of the wagering areas 14, 16, 18, 20, 24. In a preferred design, the dealer's console 36 is 7 inches in length, 5 inches in width, and 1½ inches in height.

During the play of a game, upon turning over the "action card" the dealer will press the appropriate activation buttons 109 within the dealer's console 36, causing activation of those indicator lights 113 located on each of those wagering areas 14, 16, 18, 20, 24 that define the winning wagers. For example, if the Ace of Spades were selected as the "action card," the dealer would press the activation buttons 109 relating to the "ace" card and the "spade" suit. The wagering areas 14, 16, 18, 20, 24, in turn, would have illuminated the appropriate winning betting spaces. Specifically, the "black" betting space 66, the "ace" betting space 76, the dependent "black" betting space 84, and the dependent "spade" betting space 94 would all be lit indicating those were the winning wagers.

My invention has been disclosed in terms of a preferred embodiment thereof, which provides an improved playing card casino game system of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A method of playing a casino game comprising the steps of:

starting each game by providing a first random event generator and a second random event generator to a dealer or a house position, said first random event generator providing on demand a multiple-member set of separately-identifiable selections, each selection comprising a possible game outcome, and said second random event generator providing on demand one or more indicia identifying at least one of said multiple member set of separately-identifiable selections provided by said first random event generator;

providing a plurality of player positions, each player position having a player betting area;

providing an interval during which each player may place one or more bets within a respective player betting area;

generating a first outcome set comprising said multiple member set of separately-identifiable selections using said first random event generator;

generating a second outcome set comprising said one or more identifying indicia using said second random event generator;

selecting from among the multiple members of said first outcome set based upon said identifying indicia of said at least one selection of said second outcome set;

defining a winning result as the game outcome selection that comprises the selected member of the first outcome set of said first random event generator;

rewarding each player having a previously-placed bet within a location in said respective player betting area that is in compliance with said winning result; and collecting each bet associated with a specific player position and betting area that is not in compliance with said winning result at the end of each game.

2. A method of playing a casino game as is described in claim 1, wherein said first random event generator comprises a deck of playing cards, and further comprising the steps of:

shuffling said deck of playing cards; and distributing individual members of said deck of playing cards at a plurality of discrete locations, forming a multiple member set of separately-identifiable playing card selections.

3. A method of playing a casino game as is described in claim 2, wherein said second random event generator comprises at least one die, each having a plurality of faces, and further comprising the steps of:

tumbling said at least one die; and evaluating an up-turned face of said at least one die upon ceasing said tumbling step.

4. A method of playing a casino game as is described in claim 3, wherein said plurality of faces on each die collectively correspond to each of said plurality of discrete locations, and wherein said selecting step comprises evaluating the playing card located at the discrete location identified by the up-turned face of said at least one die.

5. A method of playing a casino playing card game having a dealer and at least one player comprising:

(a) placing player wagers, with each player electing from a plurality of different wagering propositions that relate in a defined manner to a plurality of possible playing card game outcomes;

(b) distributing a selected number of single playing cards by the dealer from a deck of playing cards, with each of said single playing cards identified in a mutually-distinct manner from said other single playing cards;

(c) throwing a die having a plurality of faces, each of said faces corresponding to one of the mutually-distinct manners of identifying said single playing cards;

(d) revealing the value of the single playing card having the mutually distinct identity that corresponds to an up-turned face of the thrown die of step (c);

(e) determining the winning wagering propositions based upon the value of said single playing card revealed in step (d);

(f) the dealer rewarding successful wagers and the dealer collecting unsuccessful wagers in accordance with step (e).

6. A method of playing a casino playing card game as described in claim 5, wherein step (e) further comprises evaluating separate characteristics of the single playing card revealed in step (d) and defining separate wagering propositions based upon said separate characteristics.

7. A method of playing a casino playing card game as described in claim 6, wherein step (f) further comprises setting a reward based upon a player placing a wager on a face card value.

8. A method of playing a casino playing card game as described in claim 7, wherein step (f) additionally comprises setting a reward based upon one or more of said separate characteristics of the single playing card revealed in step (d).

9. A method of playing a casino playing card game as described in claim 8, wherein step (f) additionally comprises setting a reward based both upon a face card value and upon one or more of said separate characteristics of the single playing card revealed in step (d).

10. A process for playing a game of chance comprising the steps of:

(a) providing each player with a plurality of betting propositions;

(b) wagering by each player placed on one or more of said plurality of betting propositions;

(c) shuffling by a dealer of a deck of individual playing cards, each of said individual playing cards having indicia thereon that correspond to one or more of said plurality of betting propositions;

(d) selecting a plurality of said individual playing cards and distinguishing each of the selected plurality of playing cards from one another;

(e) tumbling at least one die, each die having a plurality of faces with indicia corresponding to the manner in which each of the selected plurality of playing cards is distinguished in step (d);

(f) evaluating the up-turned face on said at least one die at the conclusion of step (e);

(g) revealing a face value of the selected plurality of playing cards that is distinguished in a manner corresponding to the evaluated value of step (f);

(h) the dealer rewarding successful wagers placed upon those betting propositions that correspond to the face value of the playing card of step (g); and (i) concluding the game by collecting all unsuccessful bets in accordance with step (h).

* * * * *